US010060420B2

(12) United States Patent
Dohms

(10) Patent No.: US 10,060,420 B2
(45) Date of Patent: Aug. 28, 2018

(54) HIGH-PRESSURE PUMP

(71) Applicant: Robert Bosch GmbH, Stuttgart (DE)

(72) Inventor: Ralf Dohms, Aachen (DE)

(73) Assignee: Robert Bosch GmbH, Stuttgart (DE)

( * ) Notice: Subject to any disclaimer, the term of this patent is extended or adjusted under 35 U.S.C. 154(b) by 282 days.

(21) Appl. No.: 14/898,986

(22) PCT Filed: Apr. 29, 2014

(86) PCT No.: PCT/EP2014/058689
§ 371 (c)(1),
(2) Date: Jan. 18, 2016

(87) PCT Pub. No.: WO2014/202266
PCT Pub. Date: Dec. 24, 2014

(65) Prior Publication Data

US 2016/0153413 A1 Jun. 2, 2016

(30) Foreign Application Priority Data

Jun. 21, 2013 (DE) ..... 10 2013 211 755

(51) Int. Cl.
*F04B 9/04* (2006.01)
*F02M 63/02* (2006.01)
(Continued)

(52) U.S. Cl.
CPC ..... *F04B 9/042* (2013.01); *F02M 59/06* (2013.01); *F02M 59/102* (2013.01);
(Continued)

(58) Field of Classification Search
CPC ..... F04B 1/0413; F04B 1/0417; F04B 9/04; F04B 9/042; F04B 9/045; F02M 59/102; F02M 59/06; F02M 63/0265
See application file for complete search history.

(56) References Cited

U.S. PATENT DOCUMENTS

2005/0126535 A1* 6/2005 Nishimaki ..... F02D 41/20 123/299
2007/0071620 A1* 3/2007 Schoetz ..... F02M 59/06 417/470

(Continued)

FOREIGN PATENT DOCUMENTS

CN 101903654 A 12/2010
CN 103154495 A 6/2013

(Continued)

OTHER PUBLICATIONS

International Search Report for Application No. PCT/EP2014/058689 dated Aug. 4, 2014 (English Translation, 2 pages).

*Primary Examiner* — Kenneth J Hansen
(74) *Attorney, Agent, or Firm* — Michael Best & Friedrich LLP

(57) ABSTRACT

A high-pressure pump including a drive shaft (2) supported about an axis of rotation (26) and having at least one cam (3). The pump includes at least two pistons (5); at least two cylinders (6) supporting the pistons (5); wherein the pistons (5) have longitudinal axes (16) oriented at an angle to each other in a projection of the piston longitudinal axes (16) in the direction of the axis of rotation (26) onto a fictitious projection plane perpendicular to the axis of rotation (26). Each of the pistons (5) is supported on a shaft rolling surface (4) of the drive shaft (2) having the at least one cam (3) indirectly by means of a respective supporting element (14) having a supporting rolling surface (15), such that a translational motion can be performed by the pistons (5) as the result of a rotational motion of the drive shaft (2), wherein the piston longitudinal axes (16) have an axial distance in the direction of the axis of rotation (26).

20 Claims, 5 Drawing Sheets

(51) Int. Cl.
*F02M 59/06* (2006.01)
*F02M 59/10* (2006.01)
*F04B 1/04* (2006.01)

(52) U.S. Cl.
CPC ..... *F02M 63/0265* (2013.01); *F04B 1/0417* (2013.01); *F04B 9/04* (2013.01); *F02M 2200/02* (2013.01)

(56) References Cited

U.S. PATENT DOCUMENTS

| | | | | |
|---|---|---|---|---|
| 2010/0092315 | A1* | 4/2010 | Collingborn ..... | F02M 59/06 417/364 |
| 2012/0036996 | A1* | 2/2012 | Haecker ..... | B60T 17/02 92/68 |

FOREIGN PATENT DOCUMENTS

| | | | |
|---|---|---|---|
| DE | 10305011 | | 8/2004 |
| DE | 10356262 | | 6/2005 |
| DE | 102004048714 | | 4/2006 |
| DE | 102006045933 | | 4/2008 |
| DE | 102007002730 | | 7/2008 |
| DE | 102009001118 | | 8/2010 |
| DE | 102009026610 | A1 | 12/2010 |
| DE | 102011007686 | | 10/2012 |
| EP | 2032850 | A1 | 3/2009 |
| EP | 2177746 | | 4/2010 |
| EP | 2299114 | | 3/2011 |
| KR | 20080093131 | A | 10/2008 |

* cited by examiner

HIGH-PRESSURE PUMP

BACKGROUND OF THE INVENTION

The present invention concerns a high-pressure pump, and a high-pressure injection system.

In high-pressure injection systems for internal combustion engines, in particular in common rail injection systems of diesel or petrol engines, a high-pressure pump permanently maintains the pressure in the high-pressure accumulator of the common rail injection system. The high-pressure pump may be driven for example by a camshaft of the internal combustion engine by means of a drive shaft. To deliver the fuel to the high-pressure pump, pre-delivery pumps are used, e.g. a gear or rotary vane pump, which are connected upstream of the high-pressure pump. The pre-delivery pump delivers the fuel from a fuel tank through a fuel line to the high-pressure pump.

Amongst others, piston pumps are used as high-pressure pumps. A drive shaft is mounted in a housing. Pistons are arranged in a cylinder radially to said drive shaft. A running roller with a roller rolling face mounted in a roller shoe lies on the drive shaft having at least one cam. The roller shoe is connected to the piston so that the piston is forced into an oscillating translational movement. A spring applies to the roller shoe a force directed radially toward the drive shaft, so that the running roller is in constant contact with the drive shaft. The running roller with the roller rolling face makes contact with the drive shaft on a shaft rolling face as a surface of the drive shaft having the at least one cam. The running roller is mounted in the roller shoe by means of a plain bearing. The longitudinal and movement axes of the oscillating pistons arranged in a V-shape have no axial spacing in the direction of the rotation axis of the drive shaft, so that the running rollers of several pistons roll overlapping on the shaft rolling face of the drive shaft. The life of the high-pressure pump is primarily limited by the number of rolls performed by the rollers on the shaft rolling face of the drive shaft, because the number of rolls determines the mechanical wear on the shaft rolling face. Since several, for example two, rollers roll overlapping on the shaft rolling face, with two running rollers, a full revolution of the drive shaft by 360° about the rotation axis of the drive shaft equates to two rolls of the running rollers on the same shaft rolling face. Disadvantageously, the high-pressure pump thus has a short life.

DE 10 2006 045 933 A1 discloses a high-pressure pump for high-pressure fuel delivery. The high-pressure pump has a drive shaft with cams. Cylindrical rollers supported by roller shoes lie on the cams. The roller shoes are mounted in a bore in part of the housing by means of a tappet assembly. The pump elements are attached to the tappet assembly. A coil spring presses the tappet assembly onto the cams.

DE 103 56 262 A1 discloses a radial piston pump for creating a fuel high-pressure in fuel injection systems in internal combustion engines. A drive shaft is mounted in a pump housing. Pistons rest on the drive shaft so that rotation of the drive shaft moves the pistons to and fro. Tappets are arranged between the pistons and the drive shaft.

EP 2 299 114 B1 describes a pump device for an internal combustion engine. The pump device comprises a pump housing, at least one delivery arrangement which has a delivery piston for pressurizing fuel in a pump chamber, a drive shaft carrying a cam and a cam lobe which cooperates with the delivery arrangement to drive the pistons along a piston axis, and a plate which is coupled by coupling means on one side to the cam lobe and on the other side to the housing.

DE 10 2007 002 730 B4 discloses a radial piston pump for fuel delivery in a fuel injection system of an internal combustion engine, comprising a drive shaft mounted rotatably in a pump housing and having an eccentrically formed shaft portion on which a tappet is mounted slidably and cooperates with at least one piston foot of a piston, which is arranged in a respective cylinder chamber radially relative to the drive shaft for the reciprocating motion in the direction of the piston axis. The tappet has a tappet cross section running only partially around the eccentric shaft portion.

SUMMARY OF THE INVENTION

A high-pressure pump according to the invention, in particular for a motor vehicle, for delivery of a fluid, in particular fuel, e.g. diesel, and comprising a drive shaft mounted rotatably about a rotation axis and having at least one cam, at least two pistons, at least two cylinders for mounting of the at least two pistons, the pistons each having a piston longitudinal axis, wherein on a projection of the piston longitudinal axes in the direction of the rotation axis of the drive shaft onto a theoretical projection plane perpendicular to the rotation axis, the piston longitudinal axes are oriented at an angle to each other, wherein the at least two pistons rest indirectly, each by means of a support element having a support rolling face, on a shaft rolling face of the drive shaft having the at least one cam, so that the at least two pistons can perform a translational movement as a result of the rotational movement of the drive shaft, wherein the piston longitudinal axes of the pistons have an axial spacing in the direction of the rotation axis of the drive shaft. The support elements rest or roll on the shaft rolling face so that because of the contact, a contact rolling face of the support element is present on the shaft rolling face of the drive shaft. Because of the axial spacing of the piston longitudinal axes of the pistons, the support elements rest at least partially on different shaft rolling faces of the drive shaft. In this way, the mechanical load on the shaft rolling face on the drive shaft is lower since the support elements rest at least partially on different contact rolling faces on the shaft rolling face. In this way, the mechanical load on the shaft rolling face can be reduced and hence advantageously the life of the high-pressure pump extended. The piston longitudinal axes are oriented at an angle of e.g. 60° to each other in the theoretical projection plane, so that the pistons are mutually oriented in a V-shape. Because of the angle between the piston longitudinal axes, the pistons are not arranged in a line.

In particular, the axial spacing of the piston longitudinal axes of the pistons in the direction of the rotation axis of the drive shaft amounts to at least 30%, 50%, 70% or 100% of the axial extension of the support rolling faces in the direction of the rotation axis of the drive shaft. Because of the large axial spacing of the piston longitudinal axes, the support elements rest mainly, in particular completely, on different contact rolling faces so that preferably each support element has a separate, different contact rolling face on the shaft rolling surface.

In a further embodiment, in the direction of the drive shaft rotation axis, the support rolling faces of the support elements have no mutual axial spacing or an axial spacing of at least 1%, 3%, 5% or 10% of the extension of the support rolling faces in the direction of the rotation axis of the drive shaft. With no axial spacing or a very small axial spacing of the support rolling faces, there is no overlap at the contact rolling faces of the support rolling faces on the shaft rolling face, so that hence the shaft rolling face is mechanically loaded by only one support element. Therefore there is no overlap, in particular also no partial overlap of different contact rolling faces of different support elements on the shaft rolling face.

In a supplementary embodiment, the contact rolling faces, in particular all contact rolling faces, of the support rolling faces of the support elements on the shaft rolling face of the drive shaft are at least partially, in particular completely different.

Preferably, on the projection of the piston longitudinal axes in the direction of the rotation axis of the drive shaft onto the theoretical projection plane perpendicular to the rotation axis, the piston longitudinal axes are oriented at a minimum angle to each other of between 0° and 180°, preferably between 2° and 178°, in particular between 10° and 120°, quite particularly between 20° and 100°. If the piston longitudinal axes of two pistons are mutually oriented for example at an angle of 60° or 80° in this projection, the pistons are mutually oriented for example in a V-shape.

In a variant, all pistons can rest indirectly, each by means of a support element with the support rolling face, on the shaft rolling face of just one drive shaft having the at least one cam. This support rolling face lies on the shaft rolling face.

Suitably, all support elements with the support rolling faces can rest on just one common shaft rolling face of the drive shaft having the at least one cam.

In a further embodiment, theoretical straight lines oriented parallel to the rotation axis and lying continuously without interruption on the common shaft rolling face, have a constant distance from the rotation axis of the drive shaft in the direction of the rotation axis of the drive shaft. All support elements of the pistons thus rest on a common shaft rolling face.

In particular, on the projection of the piston longitudinal axes in the direction of the rotation axis of the drive shaft onto the theoretical projection plane, all piston longitudinal axes are arranged within an angular range of 120°, and/or the support elements with the support rolling faces are configured as running rollers with roller rolling faces.

Suitably, the at least one running roller is mounted by means of at least one plain bearing or slide bearing in at least one roller shoe.

In a further embodiment, in a section perpendicular to a longitudinal axis as a rotation axis, the plain bearing surrounds the at least one running roller to an extent of more than 50%.

In particular, the plain bearing and/or the high-pressure pump and/or the contact face between the support element and the shaft roller face is lubricated by means of fuel, e.g. petrol or diesel, or oil, in particular lubricating oil.

In a further embodiment, a contact face between the support rolling face and the shaft rolling face is lubricated by fuel.

In a further variant, a camshaft is considered as a drive shaft having at least one cam.

Suitably, the drive shaft having the at least one cam is a drive shaft of circular cross section, mounted eccentrically to a central longitudinal axis of the drive shaft, so that the rotation axis has a distance from the longitudinal axis. The longitudinal axis is arranged at the center point of the circular drive shaft in the cross section.

In a further embodiment, the at least one support element is formed as a bucket tappet.

In a further embodiment, at least one elastic element, in particular a spring, can exert a force, in particular a pressure, directly or indirectly onto the at least one support element, so that the at least one support element is in constant contact with the shaft rolling face of the drive shaft.

Suitably, the at least one piston can perform an oscillating translational movement as a result of a rotational movement of the drive shaft.

In a supplementary variant, the high-pressure pump comprises, for each working chamber, an inlet valve for introduction of the fluid to be delivered into a working chamber and an outlet valve for discharge of the fluid to be delivered from the working chamber.

In a further embodiment, the at least one working chamber is delimited by a piston so that the working chamber has a different volume because of the oscillating translational movement of the at least one piston.

In a supplementary variant, the running roller is mounted with a bolt or pin on the roller shoe and the bolt or pin is arranged within a bearing bore of the running roller.

According to the invention, a high-pressure injection system for an internal combustion engine is provided, in particular for a motor vehicle, comprising a high-pressure pump, a high-pressure rail, preferably a pre-delivery pump for delivering a fuel from a fuel tank to the high-pressure pump, wherein the high-pressure pump is configured as a high-pressure pump described in this protected right application.

In a further variant, the high-pressure injection system has a metering unit which regulates or controls the quantity of fuel delivered by the pre-delivery pump to the high-pressure pump per time unit.

The pressure which can be generated by the high-pressure pump in the high-pressure rail lies for example in the range of 1000 to 3000 bar, e.g. for diesel engines, or between 40 and 400 bar, e.g. for petrol engines.

BRIEF DESCRIPTION OF THE DRAWINGS

Exemplary embodiments of the invention are described below with reference to the enclosed drawings. These show.

DETAILED DESCRIPTION

Figure 1:
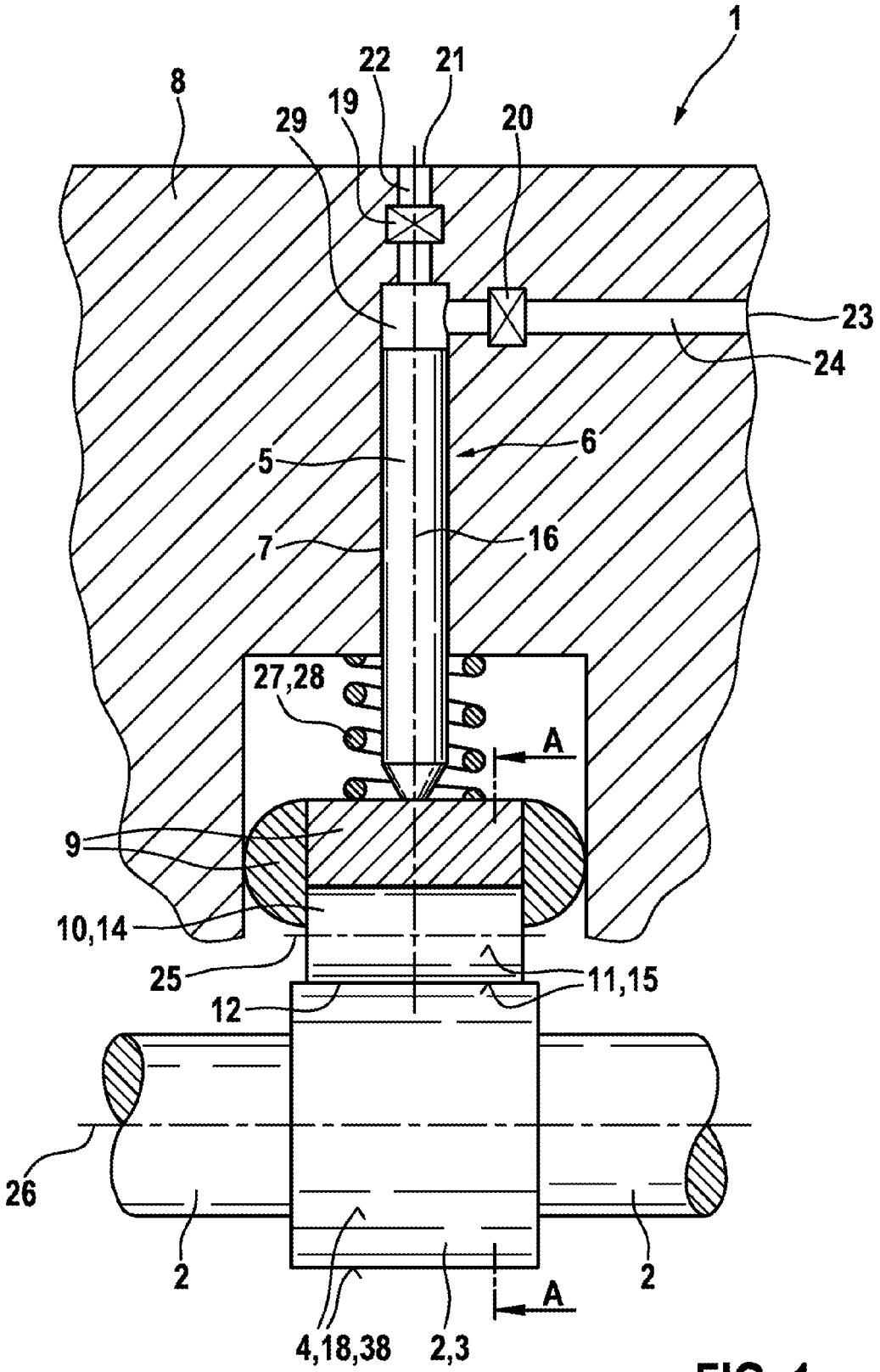
FIG. 1 a cross section of a high-pressure pump at a piston.
Figure 2:
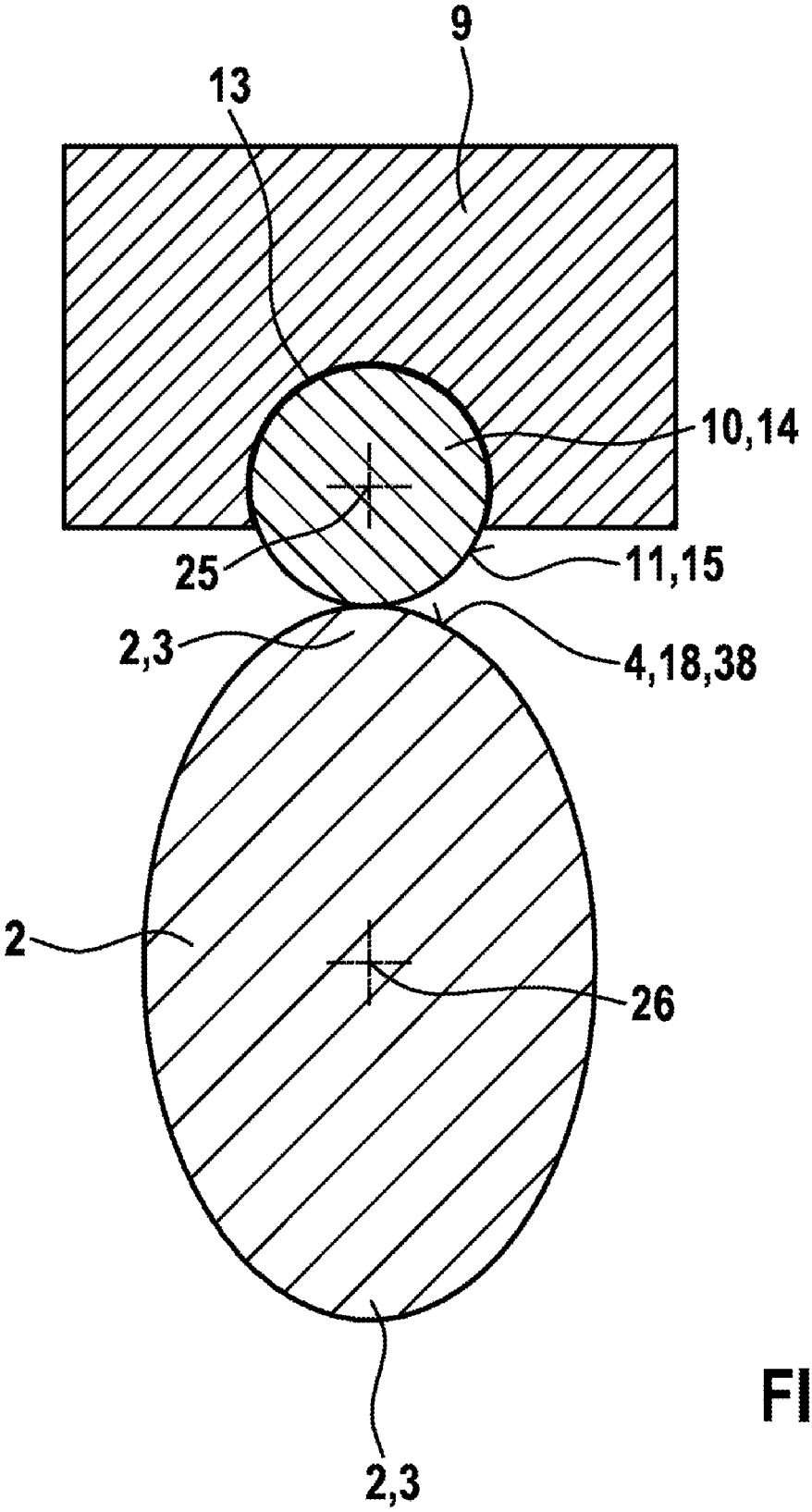
FIG. 2 a section A-A according to FIG. 1 of a running roller with roller shoe and a drive shaft, FIG. 3 a greatly simplified view of the drive shaft with two running rollers, FIG. 4 a side view of the drive shaft with two running rollers each in a roller shoe, and FIG. 5 a highly diagrammatic view of a high-pressure injection system.

FIGS. 1 and 2 show a cross section of a high-pressure pump 1 for a high-pressure injection system 36. The high-pressure pump 1 serves to deliver fuel, e.g. petrol or diesel, under high pressure to an internal combustion engine 39. The pressure which can be generated by the high-pressure pump 1 lies for example in a range between 1000 and 3000 bar.

The high-pressure pump 1 has a drive shaft 2 having two cams 3, which executes a rotational movement around a rotation axis 26. The rotation axis 26 lies in the drawing plane of FIG. 1 and stands perpendicular to the drawing plane of FIG. 2. The high-pressure pump 1 has a total of two pistons 5 mutually oriented in a V-shape. Each piston 5 is mounted in a cylinder 6 formed by a housing 8. A working chamber 29 is delimited by the cylinder 6, the housing 8 and the piston 5. An inlet channel 22 with an inlet valve 19, and an outlet channel 24 with an outlet valve 20, open into the working chamber 29. The fuel flows under high pressure into the working chamber 29 through the inlet channel 22 and back out of the working chamber 29 through the outlet channel 24. The inlet valve 19, e.g. a check valve, is configured so that fuel can only flow into the working chamber 29, and the outlet valve 20, e.g. a check valve, is configured so that fuel can only flow out of the working chamber 29. The volume of the working chamber 29 changes because of the oscillating stroke movement of the piston 5. The piston 5 rests indirectly on the drive shaft 2. A roller shoe 9 with a running roller 10 is fixed at the end of the piston 5 or pump piston 5. The running roller 10 is mounted in the roller shoe 9 by means of a plain bearing 13. The running roller 10 can execute a rotational movement, the rotation axis 25 of which lies in the drawing plane according to FIG. 1 and stands perpendicular to the drawing plane of FIG. 2. The drive shaft 2 with the two cams 3 has a shaft rolling face 4 and the running roller 10 as a support element 14 has on the outside a roller rolling face 11 as a support rolling face 15.

The roller running face 11 of the running roller 10 rolls on the shaft rolling face 4 of the drive shaft 2 having the two cams 3, so that a contact face 12 is present between the roller rolling face 11 and the shaft rolling face 4. The roller shoe 9 is mounted in a roller shoe bearing as a plain bearing formed by the housing 8. A spring 27 or coil spring 27, as an elastic element 28, clamped between the housing 8 and the roller shoe 9, applies a pressure to the roller shoe 9 so that the roller rolling face 11 of the running roller 10 is in constant contact with the shaft rolling face 4 of the drive shaft 2. The rolling shoe 9 and the piston 5 thus execute a common oscillating stroke movement.

Figure 3:
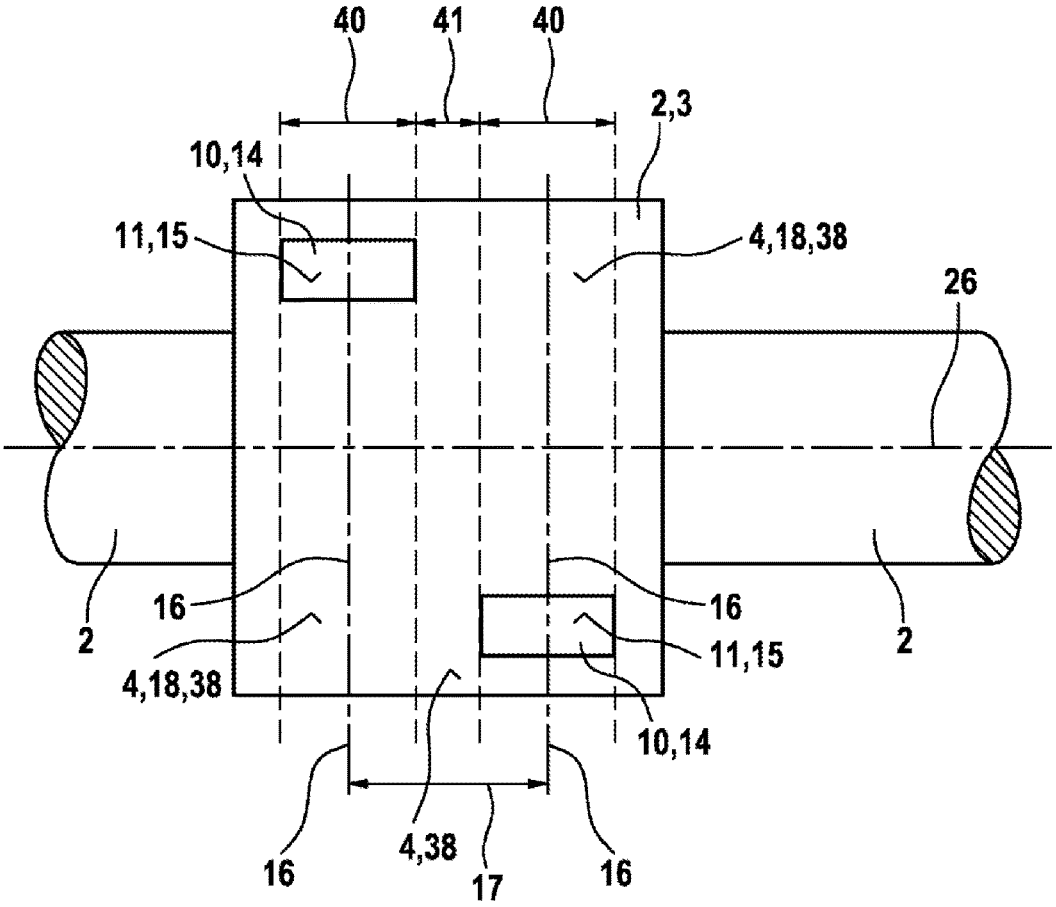
Figure 4:
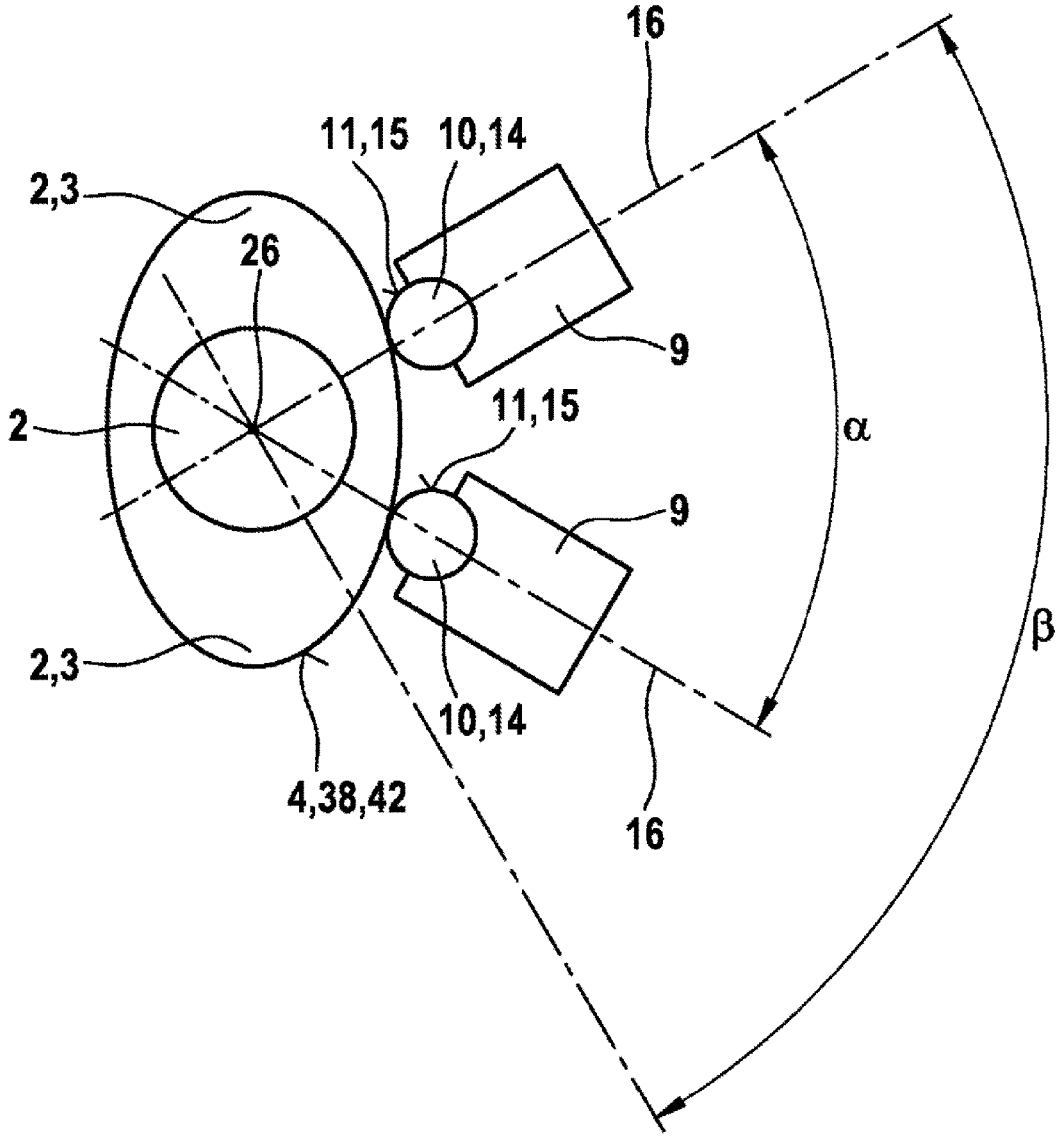

FIG. 3 shows a view radially onto the drive shaft 2 with two running rollers 10, and FIG. 4 depicts an axial side view of the drive shaft with two running rollers 10 each in a roller shoe 9. The drawing plane of FIG. 3 lies parallel to the rotation axis 26, and the drawing plane of FIG. 4 stands perpendicular to the rotation axis 26. The high-pressure pump 1 has two pistons 5 mutually oriented in a V-shape. In a projection in the direction of the rotation axis 26 of the piston longitudinal axes 16, which also form a piston movement axis 16, onto a theoretical projection plane perpendicular to the rotation axis 26, the piston longitudinal axes 16 are oriented at an angle $\alpha$ of around 60° to each other. The theoretical projection plane corresponds to the drawing plane of FIG. 4. The piston longitudinal axes 16 are here oriented centrally on the running rollers 10 in the direction of the rotation axis 26 of the drive shaft 2. The axial spacing 17 of the piston longitudinal axes 16 in the direction of the rotation axis 26 of the drive shaft 2 is greater than the axial extension 40 of the roller rolling face 11 of the running roller 10 or the axial extension 40 of the running roller 10 as a support element 14 with the support rolling face 15. Thus there is an axial distance 41 between the two roller rolling faces 11 or support rolling faces 15, or the two running rollers 10. The roller rolling faces 11 of the running rollers 10 rest or roll on the shaft rolling face 4 of the drive shaft 2, so that in this way at the contact region between the running roller 10 and the drive shaft 2, a contact rolling face 18 of the running roller 10 is present on the drive shaft 2, i.e. the shaft rolling face 4. Because of the axial distance between the running rollers 10, the axial distance 41 also exists between the contact rolling faces 18 of the running rollers 10 on the shaft rolling face 4. The contact rolling faces 18 of the two running rollers 10 on the shaft rolling face 4 of the drive shaft 2 are thus different, i.e. there is no overlap of the contact rolling faces 18 of the two running rollers 10 on the shaft rolling face 4 of the drive shaft 2. The two piston longitudinal axes 16 of the two pistons 5 are arranged within an angular range $\beta$ of 90°.

Figure 5:
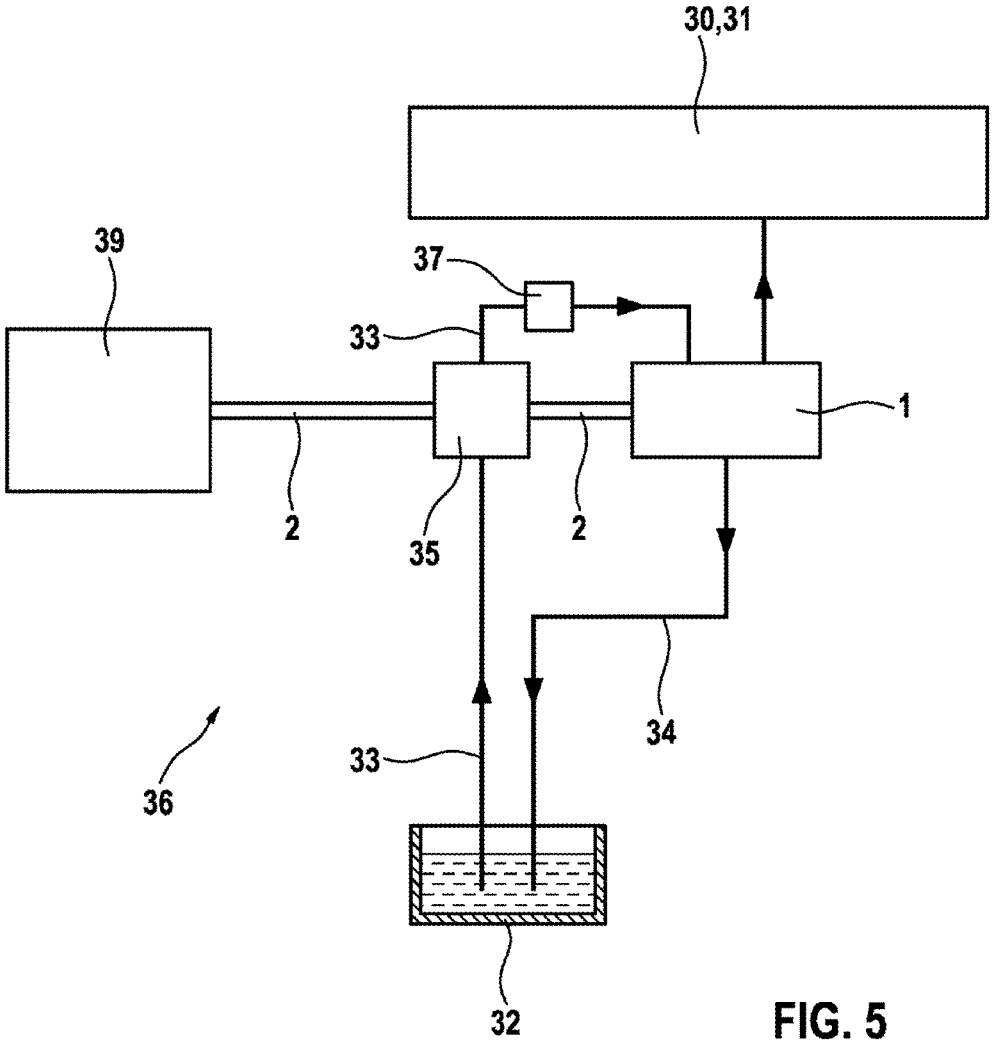

FIG. 5 shows highly diagrammatically the high-pressure injection system 36 for a motor vehicle (not shown) with a high-pressure rail 30 or a fuel distribution pipe 31. From the high-pressure rail 30, the fuel is injected by means of valves (not shown) into the combustion chamber of the internal combustion engine 39. A pre-delivery pump 35 delivers fuel from a fuel tank 32 through a fuel line 33 to the high-pressure pump 1 according to the exemplary embodiment described above. The high-pressure pump 1 and the pre-delivery pump 35 are here driven by the drive shaft 2. The drive shaft 2 is coupled by means of a crankshaft of the internal combustion engine 39. The high-pressure rail 30—as already described—serves to inject the fuel into the combustion chamber of the internal combustion engine 39. The fuel delivered by the pre-delivery pump 35 is conducted through the fuel line 33 to the high-pressure pump 1. The fuel not required by the high-pressure pump 1 is then returned through a fuel return line 34 to the fuel tank 32. A metering unit 37 controls and/or regulates the quantity of fuel supplied to the high-pressure pump 1, so that in a further embodiment (not shown), the fuel return line 34 may be omitted.

Viewed as a whole, considerable advantages are achieved with the high-pressure pump 1 according to the invention and the high-pressure injection system 36 according to the invention. The two running rollers 10 rest or roll on a common shaft rolling face 38 of the drive shaft 2. The contact rolling face 18 of one running roller 10 on the shaft rolling face 4 is completely separate from the contact rolling face 18 of the second or other running roller 10, so that in this way the shaft rolling face 4 of the common shaft rolling face 38 is in each case separately mechanically loaded by just one running roller 10. On a rotational movement of the drive shaft 2 with a complete rotation of 360°, thus only a single roll on the shaft rolling face 4 takes place in a section perpendicular to the rotation axis 26. The mechanical load on the shaft rolling face 4 from the running rollers 10 is thus substantially reduced so that the high-pressure pump 1 advantageously has a substantially longer life.

The invention claimed is:

1. A high-pressure pump (1), comprising a drive shaft (2) mounted rotatably about a rotation axis (26) and having at least one cam (3), at least two pistons (5), at least two cylinders (6) for mounting of the at least two pistons (5), the pistons (5) each having a piston longitudinal axis (16), wherein on a projection of the piston longitudinal axes (16) in a direction of the rotation axis (26) of the drive shaft (2) onto a theoretical projection plane perpendicular to the rotation axis (26), the piston longitudinal axes (16) are oriented at an angle to each other, wherein the at least two pistons (5) rest indirectly, each by means of a support element (14) having a support rolling face (15), on a shaft rolling face (4) of the drive shaft (2) having the at least one cam (3), so that the at least two pistons (5) can perform a translational movement as a result of rotational movement of the drive shaft (2), characterized in that the piston longitudinal axes (16) have an axial spacing (17) in the direction of the rotation axis (26) of the drive shaft (2), contact rolling faces (18), of the support rolling faces (15) of the support elements (14) on the shaft rolling face (4) of the drive shaft (2) are separate from each other along the rotation axis (26) so as not to overlap each other, and all support elements (14) with the support rolling faces (15) rest on just one common shaft rolling face (4) of the drive shaft (2) having the at least one cam (3).

2. The high-pressure pump as claimed in claim 1, characterized in that the axial spacing (17) of the piston longitudinal axes (16) of the pistons (5) in the direction of the rotation axis (26) of the drive shaft (2) amounts to at least 30% of an axial extension (40) of the support rolling faces (15) in the direction of the rotation axis (26) of the drive shaft (2).

3. The high-pressure pump as claimed in claim 1, characterized in that on a projection of the piston longitudinal axes (16) in the direction of the rotation axis (26) of the drive shaft (2) onto the theoretical projection plane, the piston longitudinal axes (16) are oriented at a minimum angle to each other of between 0° and 180°.

4. The high-pressure pump as claimed in claim 1, characterized in that all pistons (5) rest indirectly, each by means of the support element (14) with the support rolling face (15), on the shaft rolling face (4) of just one drive shaft (2) having the at least one cam (3).

5. The high-pressure pump as claimed in claim 1, characterized in that each one of a plurality of theoretical straight lines oriented parallel to the rotation axis (26) and lying continuously without interruption on the common shaft rolling face (4) has a constant distance from the rotation axis (26) of the drive shaft (2) in the direction of the rotation axis (26) of the drive shaft (2).

6. The high-pressure pump as claimed in claim 1, characterized in that, on the projection of the piston longitudinal axes (16) in the direction of the rotation axis (26) of the drive shaft (2) onto the theoretical projection plane, all piston longitudinal axes (16) are arranged within an angular range of 120°.

7. A high-pressure injection system (36) for an internal combustion engine (39), comprising a high-pressure pump (1), a high-pressure rail (30), and a pre-delivery pump (35) for delivering a fuel from a fuel tank (32) to the high-pressure pump (1), characterized in that the high-pressure pump (1) is configured as a high-pressure pump (1) as claimed in claim 1.

8. The high-pressure pump as claimed in claim 1, characterized in that the axial spacing (17) of the piston longitudinal axes (16) of the pistons (5) in the direction of the rotation axis (26) of the drive shaft (2) amounts to at least 50% of an axial extension (40) of the support rolling faces (15) in the direction of the rotation axis (26) of the drive shaft (2).

9. The high-pressure pump as claimed in claim 1, characterized in that the axial spacing (17) of the piston longitudinal axes (16) of the pistons (5) in the direction of the rotation axis (26) of the drive shaft (2) amounts to at least 70% of an axial extension (40) of the support rolling faces (15) in the direction of the rotation axis (26) of the drive shaft (2).

10. The high-pressure pump as claimed in claim 1, characterized in that the axial spacing (17) of the piston longitudinal axes (16) of the pistons (5) in the direction of the rotation axis (26) of the drive shaft (2) amounts to at least 100% of an axial extension (40) of the support rolling faces (15) in the direction of the rotation axis (26) of the drive shaft (2).

11. The high-pressure pump as claimed in claim 1, characterized in that in the direction of the rotation axis (26) of the drive shaft (2), the support rolling faces (15) of the support elements (14) have an axial spacing (41) of at least 1% of an axial extension (40) of the support rolling faces (15) in the direction of the rotation axis (26) of the drive shaft (2).

12. The high-pressure pump as claimed in claim 1, characterized in that in the direction of the rotation axis (26) of the drive shaft (2), the support rolling faces (15) of the support elements (14) have an axial spacing (41) of at least 3% of an axial extension (40) of the support rolling faces (15) in the direction of the rotation axis (26) of the drive shaft (2).

13. The high-pressure pump as claimed in claim 1, characterized in that in the direction of the rotation axis (26) of the drive shaft (2), the support rolling faces (15) of the support elements (14) have an axial spacing (41) of at least 5% of an axial extension (40) of the support rolling faces (15) in the direction of the rotation axis (26) of the drive shaft (2).

14. The high-pressure pump as claimed in claim 1, characterized in that in the direction of the rotation axis (26) of the drive shaft (2), the support rolling faces (15) of the support elements (14) have an axial spacing (41) of at least 10% of an axial extension (40) of the support rolling faces (15) in the direction of the rotation axis (26) of the drive shaft (2).

15. The high-pressure pump as claimed in claim 1, characterized in that all contact rolling faces (18) of the support rolling faces (15) of the support elements (14) on the shaft rolling face (4) of the drive shaft (2) have axial spacing therebetween.

16. The high-pressure pump as claimed in claim 1, characterized in that on the projection of the piston longitudinal axes (16) in the direction of the rotation axis (26) of the drive shaft (2) onto the theoretical projection plane, the piston longitudinal axes (16) are oriented at a minimum angle to each other of between 2° and 178°.

17. The high-pressure pump as claimed in claim 1, characterized in that on the projection of the piston longitudinal axes (16) in the direction of the rotation axis (26) of the drive shaft (2) onto the theoretical projection plane, the piston longitudinal axes (16) are oriented at a minimum angle to each other of between 10° and 120°.

18. The high-pressure pump as claimed in claim 1, characterized in that on the projection of the piston longitudinal axes (16) in the direction of the rotation axis (26) of the drive shaft (2) onto the theoretical projection plane, the piston longitudinal axes (16) are oriented at a minimum angle to each other of between 20° and 100°.

19. The high-pressure pump as claimed in claim 1, characterized in that the support elements (14) with the support rolling faces (15) are configured as running rollers (10) with roller rolling faces (11).

20. The high-pressure pump as claimed in claim 19, characterized in that, on the projection of the piston longitudinal axes (16) in the direction of the rotation axis (26) of the drive shaft (2) onto the theoretical projection plane, all piston longitudinal axes (16) are arranged within an angular range of 120°.

* * * * *